US005803035A

United States Patent [19]

Guntly

[11] Patent Number: 5,803,035

[45] Date of Patent: Sep. 8, 1998

[54] CARBURETOR WITH PRIMER LOCKOUT

[75] Inventor: Thomas G. Guntly, Hartford, Wis.

[73] Assignee: Briggs & Stratton Corporation, Wauwatosa, Wis.

[21] Appl. No.: 564,927

[22] Filed: Nov. 30, 1995

Related U.S. Application Data

[63] Continuation of Ser. No. 433,321, May 3, 1995, abandoned.

[51] Int. Cl.[6] ..... F02M 1/10

[52] U.S. Cl. ..... 123/179.11; 123/179.13; 261/72.1; 261/DIG. 8

[58] Field of Search ..... 123/179.11, 179.12, 123/179.13; 261/DIG. 8, 72.1

[56] References Cited

U.S. PATENT DOCUMENTS

| | | | |
|---|---|---|---|
| 1,365,755 | 1/1921 | Waterhouse | 123/179.13 |
| 1,544,306 | 6/1925 | Franzen | 123/179.13 |
| 2,793,634 | 5/1957 | Ericson | 123/179.3 |
| 2,985,159 | 5/1961 | Moseley | 123/179.16 |
| 3,704,697 | 12/1972 | Weymann | 123/407 |
| 3,706,444 | 12/1972 | Masaki et al. | 261/39.5 |
| 3,872,851 | 3/1975 | Matsumoto et al. | 123/179.15 |
| 4,373,479 | 2/1983 | Billingsley et al. | 123/179.11 |
| 4,498,434 | 2/1985 | Baltz et al. | 123/179.11 |
| 4,499,032 | 2/1985 | Shibano | 261/72.1 |
| 4,508,068 | 4/1985 | Tuggle et al. | 123/179.11 |
| 4,554,896 | 11/1985 | Sougawa | 123/179.16 |
| 4,703,739 | 11/1987 | Yogo | 123/520 |
| 4,836,157 | 6/1989 | Miller | 123/179.11 |
| 4,848,290 | 7/1989 | Miller | 123/179.13 |
| 4,905,641 | 3/1990 | Miller | 123/179.13 |
| 4,926,808 | 5/1990 | Kandler | 123/179.11 |
| 5,129,377 | 7/1992 | Taska | 123/179.11 |
| 5,309,875 | 5/1994 | Gault | 123/179.16 |

*Primary Examiner*—Andrew M. Dolinar
*Attorney, Agent, or Firm*—Michael Best & Friedrich LLP

[57] ABSTRACT

A carburetor prevents priming of a combustion engine under certain operating conditions. The carburetor includes a body member having a wall portion defining an orifice extending through the body member, a fuel nozzle positioned through the wall portion and in operative communication with the orifice, a fuel bowl positioned in operative communication with the fuel nozzle, a primer device in operative communication with the fuel bowl, and a primer lockout operatively positioned between the primer device and the fuel bowl. A method of controlling the carburetor during start-up and warm-up of a combustion engine is also described, including the steps of actuating the primer device to prime the carburetor, starting the engine with the external vent in open communication with the fuel bowl, disabling the primer device when the engine reaches a first operating temperature, and closing the external vent when the engine reaches a second operating temperature.

30 Claims, 2 Drawing Sheets

FIG. 1
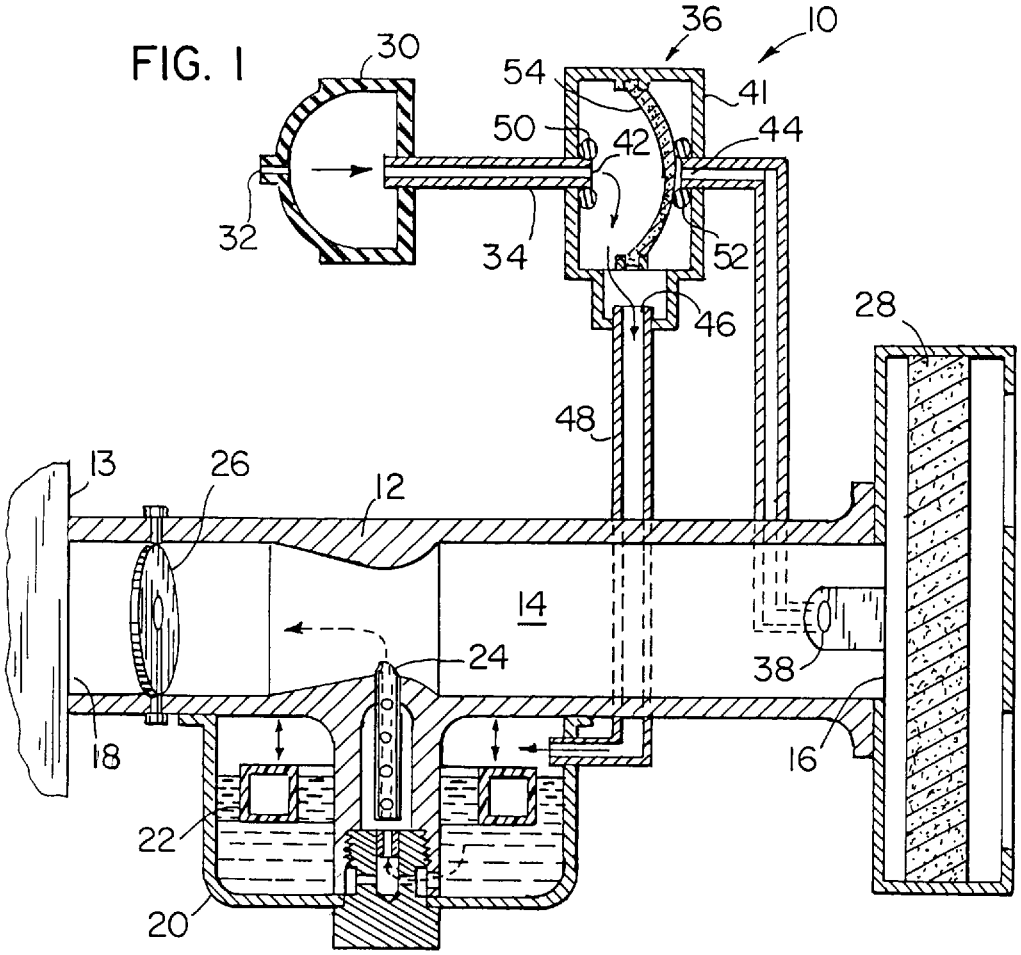
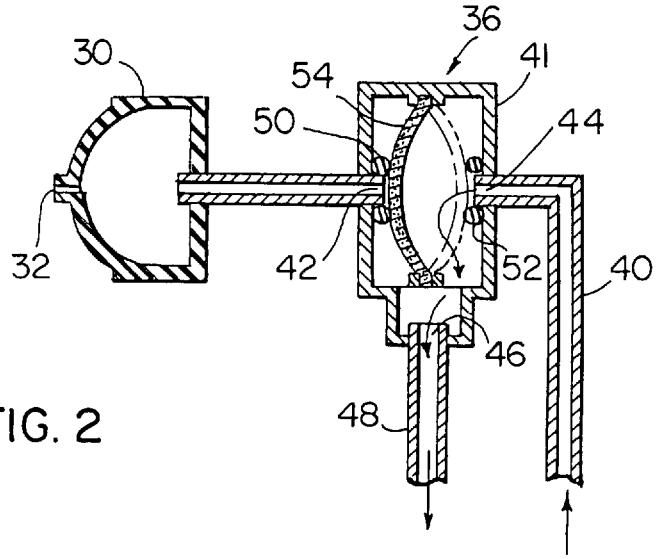
FIG. 2

CARBURETOR WITH PRIMER LOCKOUT

This is a Continuation of application Ser. No. 08/433,321, filed May 3, 1995, now abandoned.

FIELD OF THE INVENTION

The present invention generally relates to the field of carburetors for combustion engines and, more particularly, to carburetors that utilize primer devices for enhancing start-up of combustion engines.

BACKGROUND OF THE INVENTION

Most carburetors used with combustion engines are calibrated to provide a particular air/fuel ratio at normal operating temperatures. Unfortunately, the air/fuel ratio required at normal operating temperatures is much leaner than the air/fuel ratio required during start-up and cold temperature operation. As a result, some carburetors for combustion engines include enriching devices that allow the air/fuel mixture of a combustion engine to be enriched during start-up and cold temperature operation. For example, carburetors are known to include choke mechanisms that can restrict the air supply to the engine, thereby enriching the air/fuel mixture. Some carburetors include fuel bowl vents that can increase the air pressure within the fuel bowl (e.g., by externally venting), thereby increasing the amount of fuel provided to the engine and correspondingly enriching the air/fuel mixture. Carburetors have also been provided with fuel well vents that can restrict the amount of air provided to the main fuel nozzle, thereby increasing the amount of the fuel entering the engine.

Carburetors are also sometimes provided with primer devices that prepare the carburetor for engine start-up. Such primer devices typically include a mechanism whereby fuel can be provided directly to the orifice (e.g., venturi throat) of the carburetor or directly to the combustion chamber of the engine prior to cold start-up. For example, primer devices may include a pressurizing circuit (e.g., a primer bulb operatively interconnected with the fuel bowl) that can pressurize the fuel bowl prior to starting the engine. Such pressurizing of the fuel bowl results in fuel being injected directly into the orifice of the carburetor. Alternatively, carburetors may include liquid fuel primers, wherein fuel is pumped from the fuel bowl to the orifice, or well pressurizers, wherein the fuel well is pressurized to push fuel up through the fuel nozzle. Primer devices are typically only required to be used during cold start-up of the combustion engine.

Complicated electronic devices for priming engines are known. Such devices can vary the amount of priming fuel based upon certain variables. In order to function, these devices require an electronic control circuit and a battery for providing power to the electronic circuit. Electronic control circuits are not desirable for use on portable devices, such as lawn mowers, chain saws, weed trimmers, etc. due to their manufacturing expense and increased weight due to the requirement of a battery and charging system.

SUMMARY OF THE INVENTION

The present invention is directed to a primer lockout that prevents priming of a combustion engine under certain operating conditions. For example, the primer lockout may prevent priming of the engine when the engine is running and/or when the engine is already warmed-up. A primer lockout is beneficial in that it will prevent over-priming of the combustion engine. Over-priming can result in increased emissions from a running engine, and can further result in flooding of a non-running engine (e.g., an engine that is already warm). The primer lockout may further incorporate an enriching lockout that disables the enriching device of a combustion engine under the same or different operating conditions as the primer lockout. For example, the enriching lockout may prevent enriching of the combustion engine when the engine is warmed-up, thereby improving fuel economy and decreasing undesirable emissions.

In one aspect, the present invention is embodied in a carburetor for use with a combustion engine. The carburetor includes a body member having a wall portion defining an orifice extending through the body member, a primer device in operative communication with the orifice, a primer lockout operatively positioned between the primer device and the orifice, and an enriching device in operative communication with the orifice. In one embodiment, the primer lockout is preferably operatively positioned between the enriching device and the orifice, such that the primer lockout also acts as an enriching lockout.

The primer lockout preferably includes a primer port in operative communication with the primer device, an enriching port in operative communication with the enriching device, an orifice port in operative communication with the orifice, and a temperature-sensitive member movable between a first position, in which the primer port and the enriching port are in operative communication with the orifice port, and a second position, in which the primer port and the enriching port are closed. The enriching device preferably includes an external vent (e.g., integral with the primer device) in operative communication with a fuel bowl of the carburetor. The carburetor can further include an internal vent in operative communication with the fuel bowl. In addition, the primer lockout can further include an internal vent port that is in operative communication with the fuel bowl when the temperature-sensitive member is in the second position to thereby internally vent the fuel bowl.

In another embodiment, the carburetor further includes a fuel bowl, and the primer device includes a primer bulb and a conduit member interconnected on one end with the primer bulb and interconnected on another end with the fuel bowl. In this embodiment, the primer lockout preferably includes a thermal switch operatively positioned between the primer bulb and the fuel bowl. The conduit member defines a primer path between the primer bulb and the fuel bowl, and the thermal switch is movable between a first position, in which the primer path is open, and a second position, in which the primer path is closed.

In still another embodiment, the primer lockout comprises an external vent in operative communication with the primer device, and a vent lockout for selectively opening and closing the external vent to thereby selectively disable and enable the primer device. For example, the carburetor can further include a fuel bowl, and the primer device can be operatively interconnected with the fuel bowl at a first location in the fuel bowl, and the external vent can be operatively interconnected with the fuel bowl at the first location. Alternatively, the external vent can be operatively interconnected with the fuel bowl at a second location spaced from the first location.

In another aspect of the present invention, the carburetor includes a body member having a wall portion defining an orifice extending through the body member, a primer device (e.g., a primer bulb and primer conduit) for providing fuel to the orifice prior to engine start-up, a primer lockout (e.g., a thermal switch operatively positioned between the primer bulb and the fuel bowl) that disables the primer device under a predetermined set of conditions (e.g., when the temperature rises above a predetermined temperature), and an enriching device for enriching an air/fuel mixture in the orifice. Preferably, the primer lockout also disables the enriching device under the predetermined set of conditions so that the primer lockout also acts as an enriching lockout.

In yet another aspect, the invention is embodied in a method of controlling a carburetor during start-up and warm-up of a combustion engine. A suitable carburetor for performing the method includes a body member having an orifice, a primer device, and an enriching device. The method includes the steps of actuating the primer device to prime the carburetor, starting the engine, actuating the enriching device, and disabling the primer device when the engine reaches a first operating temperature. The method preferably further includes the step of disabling the enriching device when the engine reaches a second operating temperature. In one embodiment, the second operating temperature is the same as the first operating temperature and, accordingly, the steps of disabling the primer device and disabling the enriching device occur substantially simultaneously.

The carburetor can further include a fuel bowl, and the enriching device may comprise an external vent in open communication with the fuel bowl during engine start-up. In this embodiment, the external vent will be closed when the second predetermined temperature is reached. The carburetor can further include an internal vent that is closed during the step of starting the engine and, correspondingly, the method can further include the step of opening the internal vent when the engine reaches a third operating temperature. Preferably, the third operating temperature is the same as the second operating temperature and, accordingly, the steps of closing the external vent and opening the internal vent occur substantially simultaneously. More preferably, the first operating temperature, the second operating temperature and the third operating temperature are all the same as each other and, accordingly, the steps of disabling, closing and opening occur substantially simultaneously.

BRIEF DESCRIPTION OF THE DRAWINGS

FIG. 1 is a schematic side section view of a carburetor assembly embodying the present invention with the thermal switch in the cold position.

FIG. 2 is the schematic view of FIG. 1 with the thermal switch in the warm position.

DETAILED DESCRIPTION

Figure 3:
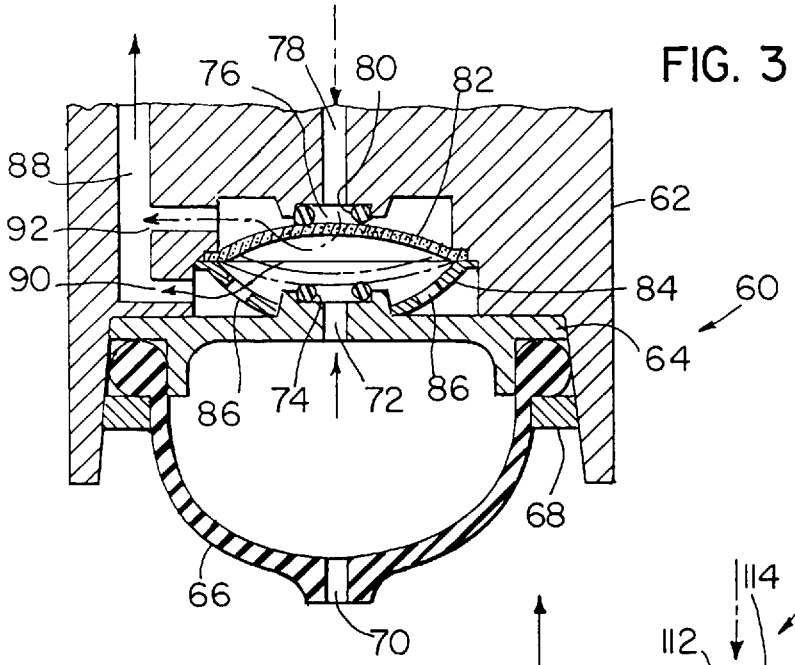
FIG. 3 is a schematic side section view of a second embodiment of the present invention.

FIGS. 1 and 2 illustrate a carburetor assembly 10 embodying the present invention, and including both primer lockout and enriching lockout features. As used herein, a primer lockout refers to a device that prevents priming of a carburetor under a predetermined set of conditions, such as when the engine is above a predetermined temperature. Similarly, an enriching lockout refers to a device that prevents enriching of a carburetor under a predetermined set of conditions, such as when the engine is above a predetermined temperature.

The carburetor assembly 10 includes a carburetor body 12 mounted to an engine 13 and having a carburetor orifice 14 extending from a carburetor inlet 16 to a carburetor outlet 18. A fuel bowl 20 having a float 22 is secured to the bottom of the carburetor body 12. A fuel nozzle 24 operatively interconnects the fuel bowl 20 with the carburetor orifice 14 to provide fuel to the carburetor orifice 14. A throttle valve 26 is positioned within the carburetor orifice 14 to control the flow rate of air/fuel mixture through the carburetor orifice 14. An air filter 28 is interconnected with the carburetor inlet 16 to filter the air entering the carburetor orifice 14.

A primer bulb 30 is operatively interconnected with the fuel bowl 20 to allow the carburetor to be primed before the engine 13 is started. The primer bulb 30 is made from a flexible material, as is generally known, and includes an external vent 32. A primer conduit 34 interconnects the primer bulb 30 with a thermal switch 36, as will be described below.

The carburetor assembly 10 further includes an internal vent opening 38 in the side wall of the carburetor body 12 near the carburetor inlet 16. The internal vent opening 38 is operatively interconnected with the fuel bowl 20 to allow internal venting of the fuel bowl 20. An internal vent conduit 40 interconnects the internal vent opening 30 with the thermal switch 36.

The thermal switch 36 is designed to open and/or close ports when the temperature of the thermal switch 36 changes beyond a predetermined value. It should be appreciated that the desired temperature will depend on a number of considerations, such as the desired operating temperature of the engine, the location of the thermal switch relative to the engine, and the cooling characteristics of the switch. In a preferred embodiment, the thermal switch 36 is mounted directly to the engine head adjacent to the exhaust port. In this embodiment, a predetermined temperature from about 38° C. to about 48° C. is preferred. Off-the-shelf thermal switches can be obtained from Therm-O-Disc, Inc. of Mansfield, Ohio.

The thermal switch 36 includes a switch housing 41, a primer port 42 leading to the primer conduit 34, an internal vent port 44 leading to the internal vent conduit 40, and a bowl port 46 leading to a bowl conduit 48. The bowl conduit 48 operatively interconnects the thermal switch 36 with the fuel bowl 20. A primer O-ring 50 surrounds the primer port 42 and a vent O-ring 52 surrounds the internal vent port 44.

The thermal switch 36 further includes a thermal disk 54 positioned within the switch housing 41. The thermal disk 54 is a bimetallic disk made from materials having different thermal expansion coefficients. Bimetallic material can be obtained from Crest Mfg. Co. or Hood & Co., Inc. The thermal disk 54 is positioned such that, when the thermal switch 36 is below a predetermined temperature, the thermal disk 54 is in a cold position, as shown in FIG. 1. In the cold position, the thermal disk 54 is butted up against the vent O-ring 52 to block communication between the internal vent opening 38 and the fuel bowl 20. When the thermal disk 54 is in the cold position, the primer bulb 30 and external vent 32 are in operative communication with the fuel bowl 20.

When the temperature of the thermal switch 36 rises above the predetermined temperature, the thermal disk 54 will move to a warm position, as illustrated in FIG. 2. In the warm position, the thermal disk 54 is butted against the primer O-ring 50 to block communication between the primer bulb 30 (and associated external vent 32) and the fuel bowl 20, thereby functioning as a primer lockout and an enriching lockout. When the thermal disk 54 is in the warm position, the internal vent opening 38 is in operative communication with the fuel bowl 20.

It should be appreciated that the illustrated thermal switch 36 is not limited to the use of a bimetallic disk, but could instead use other types of thermal switches. For example, thermal coils, thermistors, or wax element actuators could be used, as well as any other device that opens or closes an opening with changing temperatures.

By virtue of the above-described arrangement, the carburetor assembly 10 can be operated in the following manner. First, before the engine 13 is started, the user of the engine covers the external vent 32 (e.g., with his thumb) and pushes on the primer bulb 30 several times. If the thermal switch 36 is below the predetermined temperature, the thermal disk 54 will be in its cold position (FIG. 1). Pushing of the primer bulb 30 with the thermal disk 54 in the cold position pressurizes the fuel bowl 20 to cause a small amount of fuel to be forced up through the fuel nozzle 24 and into the carburetor orifice 14 to thereby prime the carburetor. The user of the engine 13 can subsequently remove their thumb from the external vent 32 and start the engine 13. The primed carburetor will make starting the engine easier. In addition, since the fuel bowl 20 is in communication with the external vent 32, the fuel bowl 20 will be vented to the atmosphere, rather than to the low pressure of the internal vent 38, thereby enriching the air/fuel mixture and improving low temperature engine operation.

When the thermal switch 36 reaches the predetermined temperature, indicating that the engine 13 is warmed up, the thermal disk 54 will flip to its warm position (FIG. 2), thereby opening the internal vent port 44 and closing the primer port 42. Such movement of the thermal disk 54 switches the fuel bowl 20 from external venting to an internal venting, thereby decreasing the pressure within the fuel bowl 20 and leaning out the air/fuel mixture to improve engine performance. For example, improved fuel economy and decreased emissions are typically achieved. By virtue of such blocking of the external vent 32, the device acts as an enriching lockout. In addition, with the thermal disk 54 in the warm position, the primer bulb 30 is effectively disabled, thereby functioning as a primer lockout. That is, if the user of the engine attempts to push the primer bulb 30 when the thermal disk 54 is in the warm position, there will be no pressurizing of the fuel bowl 20 since the primer port 42 is closed. Leakage around the thermal disk 54 may result in a small amount of pressurizing, but not enough to result in a significant amount of priming. By virtue of this feature, the user of the engine will be prevented from priming the carburetor when the engine is running, thereby preventing over-enriching of the air/fuel mixture resulting in increased emissions. In addition, the primer lockout feature prevents the user of the engine from priming the engine when it is warm, even when the engine is not running, thereby inhibiting flooding of the engine.

FIG. 3 illustrates a second embodiment of the present invention wherein the thermal switch is incorporated into a primer assembly 60. The primer assembly 60 includes a primer housing 62, a bulb seat 64, a primer bulb 66, and a bulb retaining ring 68 for holding the primer bulb 66 seated against the bulb seat 64 within the primer housing 62. The primer bulb 66 includes an external vent 70, and the bulb seat 64 includes a primer port 72 surrounded by a primer O-ring 74. The primer housing 62 includes an internal vent port 76 in communication with an internal vent path 78 leading to an internal vent opening (not shown). The internal vent port 76 is surrounded by an internal vent O-ring 80. A thermal disk 82 is mounted within the primer housing 62, and is retained by a disk retaining clip 84. The disk retaining clip 84 includes clip openings 86 for allowing communication through the disk retaining clip 84. The primer housing 62 further includes a bowl path 88 in communication with the fuel bowl (not shown). A primer passageway 90 provides communication between the clip openings 86 and the bowl path 88. A vent passageway 92 provides communication between the internal vent port 76 and the bowl path 88.

When the primer assembly 60 illustrated in FIG. 3 is below the predetermined temperature, the thermal disk 82 will be positioned in the cold position, as illustrated in solid lines. In this position, the thermal disk 82 is in contact with the internal vent O-ring 80, thereby preventing communication between the internal vent path 78 and the bowl path 88. Conversely, the primer bulb 66 (and associated external vent 70) are in communication with the bowl path 88 through the clip openings 86 and primer passageway 90.

When the primer assembly 60 reaches the predetermined temperature, the thermal disk 82 will flip to its warm position, as illustrated in dashed lines in FIG. 3. In this position, the thermal disk 82 is butted against the primer O-ring 74, thereby preventing communication between the primer bulb 66 (and associated external vent 70) and the bowl path 88, thereby acting as both a primer lockout and an enriching lockout. The internal vent path 78, on the other hand, will be in communication with the bowl path 88 through the vent passageway 92. Use and operation of the primer assembly 60 is similar to that described above with respect to the embodiment illustrated in FIGS. 1 and 2.

Figure 4:
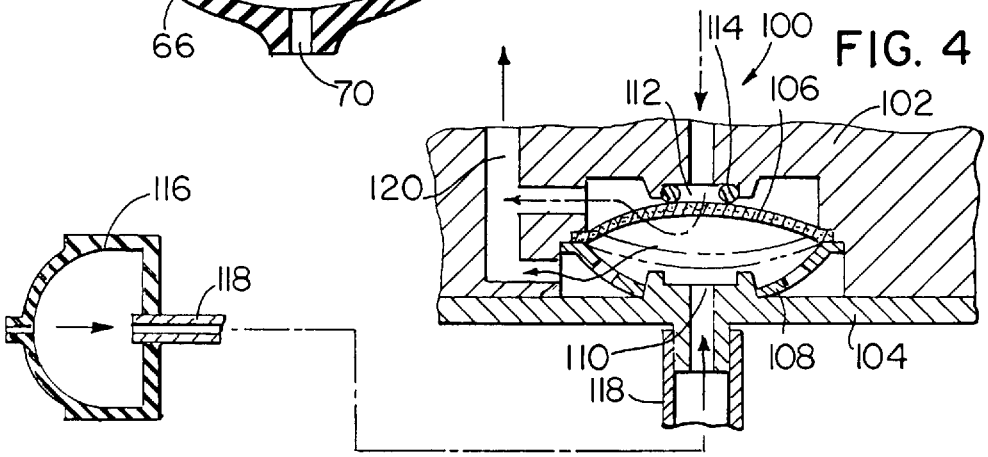
FIG. 4 is a schematic side section view of a third embodiment of the present invention.

FIG. 4 illustrates a third embodiment comprising a thermal switch assembly 100 that provides a primer lockout feature, but not an enriching lockout feature. The thermal switch assembly 100 includes a switch housing 102, a switch end 104, a thermal disk 106, a retaining clip 108, a primer port 110, an external vent port 112, and an external vent O-ring 114. The primer port 110 is interconnected with a primer bulb 116 by a primer conduit 118. The assembly is operatively interconnected with a fuel bowl (not shown) via a bowl path 120.

When the thermal switch assembly 100 is below the predetermined temperature, the thermal disk 106 will be butted against the external vent O-ring 114, as shown in solid lines in FIG. 4. When in this position, the primer bulb 116 can be pushed to pressurize the fuel bowl (not shown) and prime the carburetor, as is described above in more detail with respect to the previously-described embodiments. When the assembly reaches a predetermined temperature, the thermal disk 106 will flip to the position shown in dashed lines in FIG. 4. In this position, although the primer port 110 is not blocked, the primer bulb 116 is effectively disabled since any pushing of the primer bulb 116 will merely push air out the external vent port 112, rather than pushing air into the fuel bowl to pressurize the fuel bowl. It should be noted that the embodiment of FIG. 4 does not switch from external venting to internal venting as is the case with the embodiments of FIGS. 1 through 3.

Figure 5:
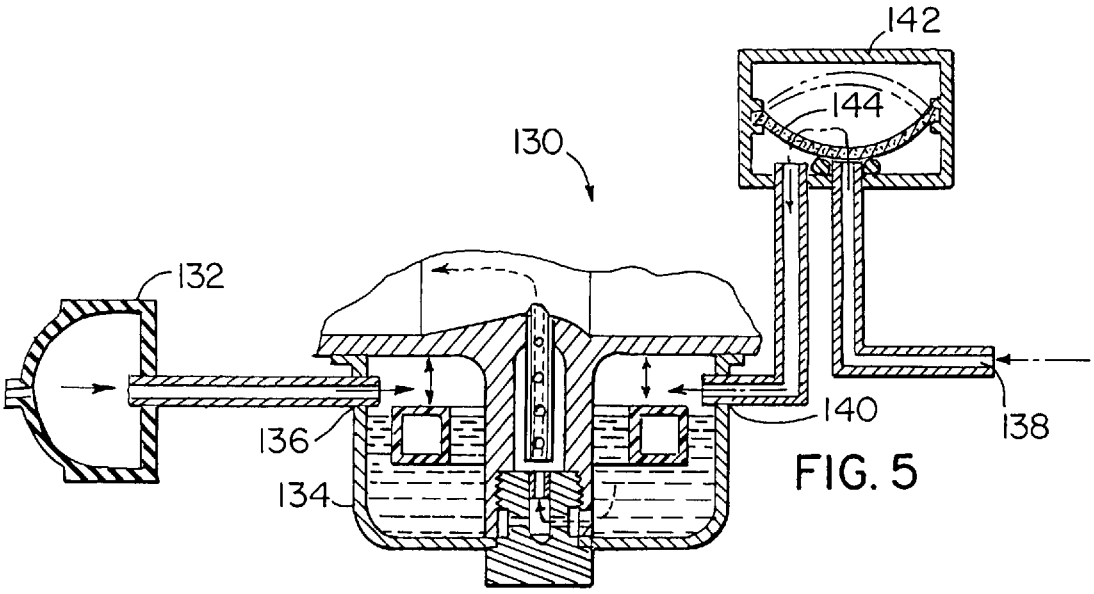
FIG. 5 is a schematic side section view of a fourth embodiment of the present invention.

FIG. 5 illustrates a fourth embodiment of the present invention. The fourth embodiment includes a carburetor assembly 130 having a primer bulb 132 interconnected with a fuel bowl 134 at a first location 136, an external vent 138 interconnected with the fuel bowl 134 at a second location 140 different than the first location 136, and a thermal switch 142 operatively interposed between the external vent 138 and the fuel bowl 134. The thermal switch 142 includes a thermal disk 144 that is movable between a cold position, in which the external vent 138 is blocked, and a warm position, in which the external vent 138 is open. Operation of the illustrated assembly is substantially the same as the assembly illustrated in FIG. 4 and described above.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A carburetor for use with a combustion engine, said carburetor comprising:

a body member having a wall portion defining an orifice extending through said body member;

a primer device in operative communication with said orifice;

a primer lockout operatively positioned between said primer device and said orifice; and an enriching device in operative communication with said orifice.

2. A carburetor, as claimed in claim 1, wherein said primer lockout is operatively positioned between said enriching device and said orifice, and wherein said primer lockout is also an enriching lockout.

3. A carburetor, as claimed in claim 2, wherein said primer lockout comprises a temperature-sensitive member movable between a first position, in which said primer device and said enriching device are in operative communication with said orifice, and a second position, in which said primer device and said enriching device are blocked from communication with said orifice.

4. A carburetor, as claimed in claim 3, further comprising a fuel bowl, wherein said enriching device comprises an external vent in operative communication with said fuel bowl, wherein said carburetor further comprises an internal vent in operative communication with said fuel bowl, and wherein said internal vent is in operative communication with said fuel bowl when said temperature-sensitive member is in said second position.

5. A carburetor, as claimed in claim 4, wherein said external vent is integral with said primer device.

6. A carburetor, as claimed in claim 1, further comprising a fuel bowl, and wherein said primer device comprises:

a primer bulb; and a conduit member interconnected on one end with said primer bulb and interconnected on another end with said fuel bowl.

7. A carburetor, as claimed in claim 6, wherein said primer lockout comprises a thermal switch operatively positioned between said primer bulb and said fuel bowl.

8. A carburetor, as claimed in claim 7, wherein said conduit member defines a primer path between said primer bulb and said fuel bowl, and wherein said thermal switch is movable between a first position, in which said primer path is open, and a second position, in which said primer path is closed.

9. A carburetor, as claimed in claim 7, wherein said primer bulb includes an external vent.

10. A carburetor, as claimed in claim 7, wherein said thermal switch comprises a bimetallic thermal disk.

11. A carburetor, as claimed in claim 1, wherein said primer lockout comprises:

an external vent in operative communication with said primer device; and a vent lockout for selectively opening and closing said external vent to thereby selectively enable and disable said primer device.

12. A carburetor, as claimed in claim 11, further comprising a fuel bowl, wherein said primer device is operatively interconnected with said fuel bowl at a first location in said fuel bowl, and wherein said external vent is operatively interconnected with said fuel bowl at said first location.

13. A carburetor, as claimed in claim 11, further comprising a fuel bowl, wherein said primer device is operatively interconnected with said fuel bowl at a first location in said fuel bowl, and wherein said external vent is operatively interconnected with said fuel bowl at a second location spaced from said first location.

14. A carburetor for use with a combustion engine, said carburetor comprising:

a body member having a wall portion defining an orifice extending through said body member;

a primer device for providing fuel to said orifice prior to engine start-up;

a primer lockout that disables said primer device under a predetermined set of conditions; and an enriching device for enriching an air/fuel mixture in said orifice.

15. A carburetor, as claimed in claim 14, wherein said primer lockout also disables said enriching device under said predetermined set of conditions.

16. A carburetor, as claimed in claim 14, wherein said predetermined set of conditions corresponds with a temperature of said primer lockout being above a predetermined temperature.

17. A carburetor, as claimed in claim 14, further comprising a fuel bowl, and wherein said primer device comprises:

a primer bulb; and a conduit member interconnected on one end with said primer bulb and interconnected on another end with said fuel bowl.

18. A carburetor, as claimed in claim 17, wherein said primer lockout comprises a thermal switch operatively positioned between said primer bulb and said fuel bowl.

19. A method of controlling a carburetor during start-up and warm-up of a combustion engine, the carburetor comprising a body member having an orifice, a primer device, and an enriching device, said method comprising the steps of:

actuating the primer device to prime the carburetor;

starting the engine;

actuating the enriching device to enrich an air/fuel mixture in the carburetor; and disabling the primer device when the engine reaches a first operating temperature.

20. A method, as claimed in claim 19, further comprising the step of disabling the enriching device when the engine reaches a second operating temperature.

21. A method, as claimed in claim 20, wherein the second operating temperature is the same as said first operating temperature and, accordingly, said steps of disabling the primer device and disabling the enriching device occur substantially simultaneously.

22. A method, as claimed in claim 20, wherein the carburetor further includes a fuel bowl, wherein the enriching device includes an external vent that is in open communication with the fuel bowl during said step of starting the engine, and wherein said method further comprises the step of closing the external vent when the engine reaches the second operating temperature.

23. A method, as claimed in claim 22, wherein the carburetor further comprises an internal vent that is closed during said step of starting the engine, and wherein said method further comprises the step of opening the internal vent when the engine reaches a third operating temperature.

24. A method, as claimed in claim 23, wherein the third operating temperature is the same as the second operating temperature and, accordingly, said steps of closing the external vent and opening the internal vent occur substantially simultaneously.

25. A method, as claimed in claim 23, wherein the first operating temperature, the second operating temperature and the third operating temperature are all the same as each other and, accordingly, said steps of disabling the primer device, closing the external vent, and opening the internal vent occur substantially simultaneously.

26. A method, as claimed in claim 19, wherein the carburetor further comprises a temperature-sensitive member movable between a first position, in which the primer device is in operative communication with the orifice, and a second position, in which the primer device is blocked from operative communication with the orifice, and wherein said step of disabling the primer device includes the step of moving the temperature-sensitive member from the first position to the second position.

27. An air/fuel mixing device for use with a combustion engine, said air/fuel mixing device comprising:

a body member having an orifice;

a fuel bowl;

a primer device in operative communication with said orifice, including a primer bulb;

a primer path interconnecting said primer bulb with said fuel bowl; and a primer lockout operatively positioned between said primer device and said orifice, including a temperature-sensitive thermal switch, including a bimetallic thermal disk, operatively positioned within said primer path and movable between a first position in which said primer path is open and said primer bulb is in operative communication with said orifice, and a second position, in which said primer path is closed and in which said primer bulb is blocked from communication with said orifice.

28. An air/fuel mixing device for use with a combustion engine, said air/fuel mixing device comprising a body member;

a fuel bowl;

a primer device in operative communication with said fuel bowl such that operation of said primer device increases pressure in said fuel bowl;

a primer lockout operatively positioned between said primer device and said fuel bowl, including an external vent that vents to the atmosphere, in operative communication with said primer device; and a vent lockout for selectively opening and closing said external vent to thereby selectively enable and disable said primer device.

29. The air/fuel mixing device of claim 28, wherein said primer device is operatively interconnected with said fuel bowl at a first location in said fuel bowl, and wherein said external vent is operatively interconnected with said fuel bowl at said first location.

30. An air/fuel mixing device for use with a combustion engine, said air/fuel mixing device comprising a body member having an orifice;

a fuel bowl;

a primer device in operative communication with said orifice;

a primer lockout operatively positioned between said primer device and said orifice, including an external vent in operative communication with said primer device; and a vent lockout for selectively opening and closing said external vent to thereby selectively enable and disable said primer device;

wherein said primer device is operatively interconnected with said fuel bowl at a first location in said fuel bowl, and wherein said external vent is operatively interconnected with said fuel bowl at a second location spaced from said first location.

* * * * *